US006050775A

United States Patent [19]

Erdmann et al.

[11] Patent Number: 6,050,775

[45] Date of Patent: Apr. 18, 2000

[54] RADIAL-FLOW EXHAUST-GAS TURBOCHARGER TURBINE

[75] Inventors: Wolfgang Erdmann; Siegfried Sumser, both of Stuttgart, Germany

[73] Assignee: DaimlerChrysler AG, Stuttgart, Germany

[21] Appl. No.: 09/199,455

[22] Filed: Nov. 25, 1998

[30] Foreign Application Priority Data

Nov. 27, 1997 [DE] Germany ..... 197 52 534

[51] Int. Cl.[7] ..... F01B 25/02

[52] U.S. Cl. ..... 415/164; 415/150; 415/159; 415/160; 415/161; 415/162; 415/163; 417/407; 384/138; 384/425

[58] Field of Search ..... 415/150, 159, 415/160, 161, 162, 163, 164, 165, 230; 417/407; 384/138, 425

[56] References Cited

U.S. PATENT DOCUMENTS

| | | | |
|---|---|---|---|
| 3,788,763 | 1/1974 | Nickles | 415/147 |
| 4,642,026 | 2/1987 | Ruff . | |
| 4,861,228 | 8/1989 | Todman | 415/115 |
| 5,039,277 | 8/1991 | Naudet | 415/150 |
| 5,207,559 | 5/1993 | Clevenger et al. . | |
| 5,380,152 | 1/1995 | Sikorski et al. | 415/160 |
| 5,498,128 | 3/1996 | Baets et al. | 415/164 |
| 5,518,365 | 5/1996 | Baets et al. | 415/160 |
| 5,636,968 | 6/1997 | Audet et al. | 415/160 |
| 5,730,580 | 3/1998 | Japikse . | |

FOREIGN PATENT DOCUMENTS

| | | |
|---|---|---|
| 1 049 080 | 11/1964 | European Pat. Off. . |
| 0 384 706 | 8/1990 | European Pat. Off. . |
| 39 12 348 C2 | 12/1992 | Germany . |
| 42 37 031 C1 | 2/1994 | Germany . |
| 43 09 636 A1 | 9/1994 | Germany . |
| 195 16 971 A1 | 11/1995 | Germany . |
| 39 07 504 C2 | 12/1995 | Germany . |
| 2 151 309 | 7/1985 | United Kingdom . |

*Primary Examiner*—Edward K. Look
*Assistant Examiner*—Matthew T. Shanley
*Attorney, Agent, or Firm*—Evenson McKeown Edwards & Lenahan P.L.L.C.

[57] ABSTRACT

A radial-flow exhaust-gas turbocharger turbine is provided with a row of adjustable guide blades which are rotatable via adjusting shafts mounted in a casing. The guide blades are each provided with sealing discs on their longitudinal sides running at right angles to the adjusting-shaft axes. The diameter of the sealing discs is a multiple of the thickness of the guide blades. The sealing discs which are located on the side remote from the adjusting shafts form bearing points for the guide blades in the casing.

10 Claims, 2 Drawing Sheets

RADIAL-FLOW EXHAUST-GAS TURBOCHARGER TURBINE

BACKGROUND OF THE INVENTION

This application claims the priority of German application 197 52 534.2, filed Nov. 27, 1997, the disclosure of which is expressly incorporated by reference herein.

The present invention relates to a radial-flow exhaust-gas turbocharger turbine having a row of adjustable guide blades which are rotatable via adjusting shafts mounted in a casing.

DE 43 09 636 A1 discloses a known type of exhaust-gas turbocharger turbine in which adjustable guide blades are provided to increase the turbine output, the turbine rotational speed and also the boost. The main purpose of such a turbine arranged in the exhaust-gas flow of an internal combustion engine is to drive a compressor, which feeds air, drawn in atmospherically and compressed therein, to the individual cylinders of the internal combustion engine via a boost-air line. A further purpose of such a turbine, however, is also its use during braking operation of an internal combustion engine.

For utilization during braking operation as a so-called turbobrake, the guide blades are completely closed by a corresponding rotation of their adjusting shafts. Here, however, so-called gap losses, which occur on account of unavoidable tolerances and an inevitably large clearance on account of the considerable temperature differences and changes in length resulting therefrom, are a problem.

In particular during braking operation of the exhaust-gas turbocharger turbine, there is a very large pressure difference between the regions upstream of the guide blades and downstream of the guide blades. A very high braking pressure prevails upstream of the guide blades, whereas virtually ambient pressure prevails downstream of the guide blades in the direction of the adjoining exhaust-gas system. The braking performance is therefore markedly reduced by the large gap losses. In addition, however, the relatively large gap cross-sections and small sealing areas lead to efficiency losses even during normal operation of the turbine.

Furthermore, with regard to the general prior art, reference is also made to DE 39 12 348 C2, DE 195 16 971 A1 and DE 39 07 504 C2.

SUMMARY OF THE INVENTION

An object of the present invention is to improve an exhaust-gas turbocharger turbine of the known type such that the smallest possible gap losses, in particular in the closed state of the guide blades, can occur.

According to the invention, this object has been achieved by providing that the guide blades are provided with sealing discs on their longitudinal sides running at right angles to the adjusting-shaft axes, the diameter of which sealing discs is a multiple of the thickness of the guide blades, and in that the sealing discs which are located on the side remote from the adjusting shafts form bearing points for the guide blades in the casing.

Due to the sealing discs arranged laterally on the longitudinal sides of the guide blades, a drastic reduction in the gap losses is achieved, in particular with closed guide cascade by appropriately adjusted guide blades. In particular during operation of the turbine as an engine brake, in the course of which correspondingly high pressure forces act on the guide cascade or the guide blades, markedly improved sealing and a resulting considerable increase in the braking effect are thus achieved.

This reduction in the gap losses also benefits the efficiency of the exhaust-gas turbocharger turbine during normal fired operation, since inefficient flows around the guide blades are thus likewise avoided.

A further advantage of the sealing discs according to the present invention consists in the fact that, due to the additional bearing arrangement of the guide blades via the sealing discs on the side remote from the adjusting shafts, a more robust bearing arrangement of the blading is achieved. This is advantageous in particular at the high pressure forces during braking operation. The closed guide cascade thus becomes markedly more robust.

On the adjusting-shaft side, the guide blades may be mounted in the adjusting shafts in a known manner. In an advantageous manner, however, the sealing discs may also be at least partly used on this side for the bearing arrangement, since markedly larger bearing areas are thus achieved on account of the large diameters of the sealing discs.

If provision is made in an advantageous embodiment of the present invention for the sealing discs to be at least partly provided with textured surfaces on their rear sides remote from the guide blades, gap losses are reduced even further. Due to the surface texturing, swirling and turbulence of the gap mass flow is achieved and thus the resistance to flow is greatly increased, as a result of which the gap mass flow, which is detrimental to the efficiency, can be reduced to a greater extent. A similar effect is achieved by labyrinth-sealing measures on the rear sides of the sealing discs.

BRIEF DESCRIPTION OF THE DRAWINGS

These and further objects, features and advantages of the present invention will become more apparent from the following detailed description of a currently preferred embodiments when taken in conjunction with the accompanying drawings wherein.

DETAILED DESCRIPTION OF THE DRAWINGS

Figure 1:
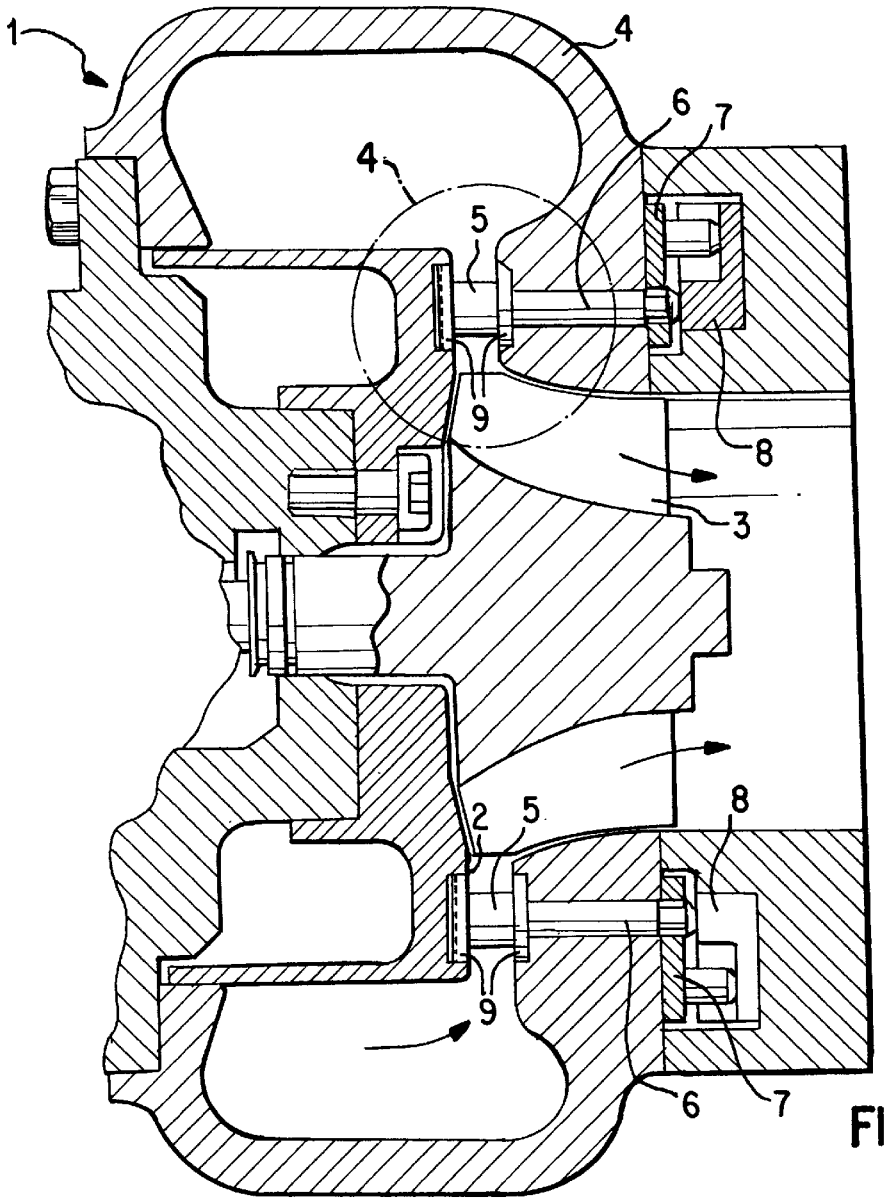
FIG. 1 is a longitudinal partial cross-sectional view through the exhaust-gas turbocharger turbine according to the present invention.

In principle, the exhaust-gas turbocharger turbine shown in FIG. 1 is of known type of construction and works in a known operating mode during both fired operation and braking operation of the internal combustion engine, for which reason only the parts essential for the invention are dealt with in more detail below.

The exhaust-gas turbocharger turbine 1 (only partly shown) has a radial inflow, effected from a spiral, to the blading and an axial outflow from the blading. The walls upstream of the moving blades 3 and defining a duct 2 through which flow occurs are inner left-hand and right-hand walls of a casing 4.

A multiplicity of peripherally distributed guide blades 5 in the duct 2 are each mounted in the casing 4 with adjusting shafts 6. At its end remote from the guide blade 5, each adjusting shaft 6 is provided with a pivoted lever 7. The adjusting levers 7 and thus the adjusting shafts 6 are adjusted together and synchronously by an actuating device 8. The angular adjustment of the adjusting levers 7 may be effected, for example, by a known actuator used in compressor construction.

Running at right angles to the longitudinal axes of the adjusting shafts 6, sealing discs 9 are arranged on the longitudinal sides, of the guide blades 5 or laterally on the guide blades 5 and are in each case constructed generally in one piece with the guide blades 5 and the adjusting shafts 6. The diameters of the sealing discs 9 correspond to at least about half the length of the guide blades 5.

Figure 4:
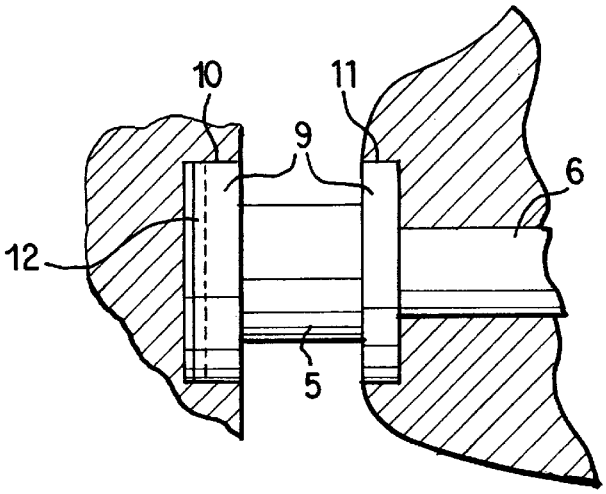
FIG. 4 is an enlarged detail of the area X shown in the dashed circle in FIG. 1.

As can be seen in particular from the enlarged representation in FIG. 4, the two lateral sealing discs 9 at the same time also form bearing points 10, 11 for the guide blades 5 in bores of the casing 4. In this way, instead of a generally conventional, only one-sided bearing arrangement of the guide blades 5, a double or two-sided bearing arrangement is obtained.

Since gap mass flows can nonetheless still take place via the bearing points 10, 11 via the rear sides of the sealing discs 9, the sealing discs 9 are provided with textured surfaces 12 on their rear sides. This is especially advantageous in each case for the bearing point 10, which is generally configured as a radial bearing. The surface texturing may be of any appropriate type and profile. It is merely essential that appropriate swirling and turbulence is produced as a result, whereby the resistance to flow is increased and the gap mass flow, which is detrimental to efficiency, via the rear gaps of the sealing discs 9 is considerably reduced.

Figure 5:
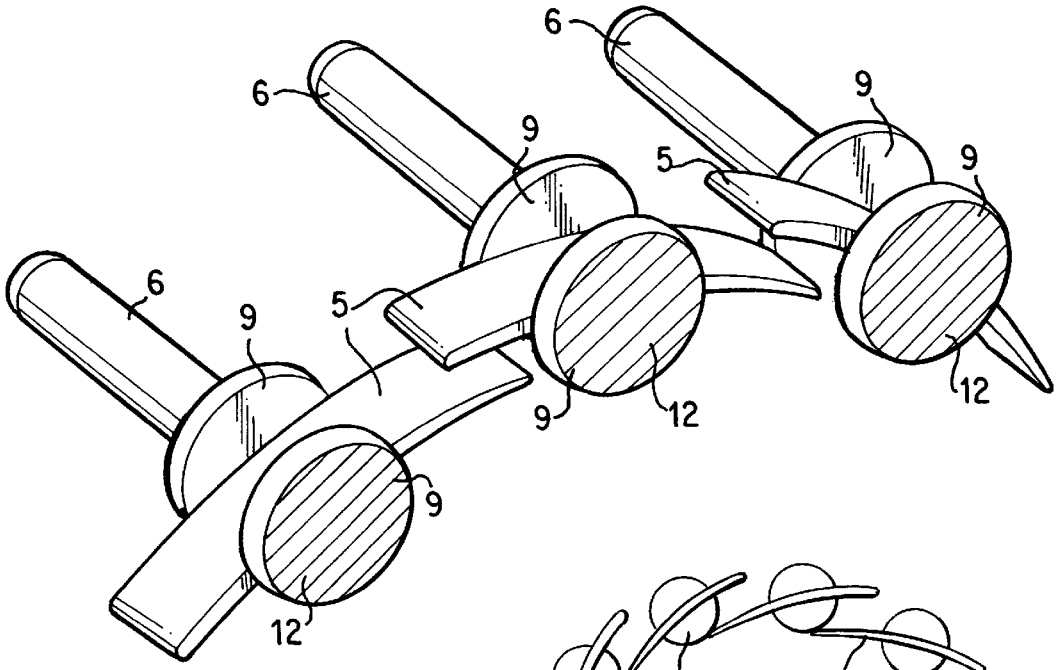
FIG. 5 is a perspective view of three guide blades lying side by side and having sealing discs and adjusting shafts.
Figure 2:
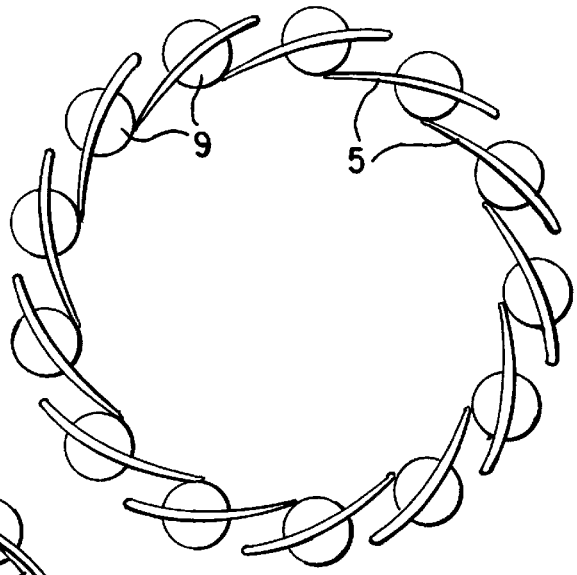
FIG. 2 is a front view of the guide cascade with the guide blades in the open state.
Figure 3:
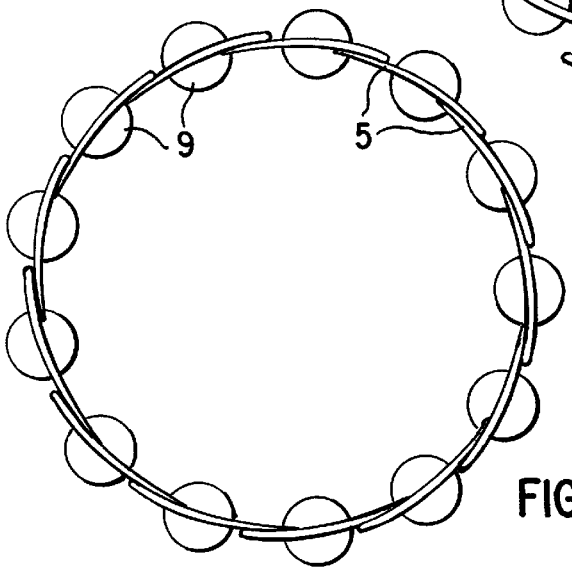
FIG. 3 is a front view of the guide cascade similar to FIG. 2 but with the guide blades in the closed state.

FIGS. 2, 3 and 5 clearly show that the gaps on both sides of the guide blades 5 are reduced to a considerable extent by the lateral sealing discs 9 because of the substantially larger diameter of the latter compared with the thickness of the guide blades 5. As can be seen in particular from FIG. 5, due to the large diameters of the sealing discs 9, a substantially longer lateral sealing area is available compared with the smaller thicknesses of the guide blades 5. This is especially true compared with the very small guide-blade thicknesses in the region of their end faces. The gap losses in the region of the front and rear ends or end faces of the guide blades 5 inevitably remain, because, for design reasons, there are limits to the diameter increases in the sealing discs 9. As can be seen in particular from FIG. 3, however, a drastic reduction in gap losses over virtually half the guide-blade lengths or even more can be achieved by suitable selection of the diameter of the sealing discs 9.

The sealing discs 9 on the sides facing the adjusting shafts 9 can, of course, also be configured purely as sealing discs. The bearing arrangement of the guide blades 5 is then effected in a known manner by the adjusting shafts 6 themselves. In this embodiment, the sealing discs 9 on this side will then likewise be provided with textured surfaces on their rear sides in order to reduce gap mass flows.

The present invention has been described above with reference to a single-entry exhaust-gas turbocharger turbine. A configuration of the guide blades 5 with the lateral sealing discs 9 is also possible in a double-entry exhaust-gas turbocharger turbine. Then, the guide blades will be located in a main flow, and a small flow is effected parallel thereto in a throttled manner via a braking cascade having very narrow gaps. Here, too, the sealing discs are advantageous for minimizing the gaps in the main flow and for a specific and precisely defined braking operation resulting therefrom. The same applies to the efficiency of a double-entry exhaust-gas turbocharger turbine in fired operation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Radial-flow exhaust-gas turbocharger turbine having a row of adjustable guide blades which are rotatable via adjusting shafts mounted in a casing, wherein the guide blades are provided with sealing discs on longitudinal sides thereof running transverse to axes of the adjusting shafts, the diameter of the sealing discs being a multiple of the thickness of the guide blades, and the sealing discs which are located on the side remote from the adjusting shafts forming bearing points for the guide blades.

2. Exhaust-gas turbocharger turbine according to claim 1, wherein the sealing discs at least partially form bearing points on a side facing the adjusting shafts.

3. Exhaust-gas turbocharger turbine according to claim 1, wherein the sealing discs are at least partially provided with textured surfaces on their rear sides thereof remote from the guide blades.

4. Exhaust-gas turbocharger turbine according to claim 3, wherein the sealing discs at least partially form bearing points on a side facing the adjusting shafts.

5. Exhaust-gas turbocharger turbine according to claim 1, wherein the sealing discs have labyrinth seals on sides thereof remote from the guide blades.

6. Exhaust-gas turbocharger turbine according to claim 5, wherein the sealing discs at least partially form bearing points on a side facing the adjusting shafts.

7. Exhaust-gas turbocharger turbine according to claim 1, wherein diameters of the sealing discs correspond at least approximately to half the length of the guide blades.

8. Exhaust-gas turbocharger turbine according to claim 7, wherein the sealing discs at least partially form bearing points on a side facing the adjusting shafts.

9. Exhaust-gas turbocharger turbine according to claim 8, wherein the sealing discs are at least partially provided with textured surfaces on their rear sides thereof remote from the guide blades.

10. Exhaust-gas turbocharger turbine according to claim 9, wherein the sealing discs have labyrinth seals on sides thereof remote from the guide blades.

* * * * *